United States Patent [19]

Schreiber

[11] 4,104,068

[45] Aug. 1, 1978

[54] SILVER HALIDE EMULSIONS CONTAINING MICROVOIDS

[75] Inventor: Karl J. Schreiber, Waban, Mass.

[73] Assignee: Polaroid Corporation, Cambridge, Mass.

[21] Appl. No.: 769,171

[22] Filed: Feb. 16, 1977

[51] Int. Cl.[2] ..... G03C 7/00; G03C 1/48; G03C 1/02; G03C 1/84

[52] U.S. Cl. ..... 96/3; 96/25; 96/29 R; 96/76 R; 96/80; 96/84 R; 96/94 R; 96/112; 96/114.7

[58] Field of Search ..... 96/94 R, 76 R, 80, 3, 96/25, 112, 84 R, 114.7, 29 R

[56] References Cited

U.S. PATENT DOCUMENTS

| | | | |
|---|---|---|---|
| 3,516,834 | 6/1970 | Audran et al. | 96/94 R |
| 3,615,427 | 10/1971 | Debroyn | 96/76 R |
| 3,726,682 | 4/1973 | Van Paesschen et al. | 96/84 R |

FOREIGN PATENT DOCUMENTS

| | | | |
|---|---|---|---|
| 504,283 | 4/1939 | United Kingdom. | |
| 907,125 | 10/1962 | United Kingdom | 96/112 |

OTHER PUBLICATIONS

"Hiding Without Pigments", H. Burrell, *J. of Paint Technology*, vol. 43, No. 559, 8/1971, pp. 48–51.

*Primary Examiner*—J. Travis Brown
*Assistant Examiner*—Richard L. Schilling
*Attorney, Agent, or Firm*—Philip G. Kiely

[57] ABSTRACT

The present invention relates to a photographic silver halide emulsion layer having disposed therein microvoids to provide photographic speed enhancement to said emulsion. The silver halide emulsion layers are particularly useful in additive multicolor photographic film units.

14 Claims, 3 Drawing Figures

SILVER HALIDE EMULSIONS CONTAINING MICROVOIDS

BACKGROUND OF THE INVENTION

Procedures for preparing photographic images in silver by diffusion transfer principles are well known in the art. For the formation of the positive silver image, a latent image contained in an exposed photosensitive silver halide emulsion is developed and almost concurrently therewith a soluble silver complex is obtained by reaction of a silver halide solvent with the unexposed and the undeveloped silver halide of said emulsion. Preferably, the photosensitive silver halide emulsion is developed with a processing composition in a viscous condition which is spread between the photosensitive element comprising the silver halide emulsion and a print receiving element comprising a suitable silver precipitating layer. The processing composition effects development of the latent image in the emulsion and, substantially contemporaneous therewith, forms a soluble silver complex, for example, a thiosulfate or thiocyanate complex, with undeveloped silver halide. This soluble silver complex is, at least in part, transported in the direction of the print receiving element and the silver ion thereof is largely reduced to silver metal and precipitated in the silver precipitating element to form a positive image thereon. Procedures of this type are disclosed, for example, in U.S. Pat. No. 2,543,181 issued to Edwin H. Land. See also Edwin H. Land; *One Step Photography;* Photographic Journal, Section A, pages 7–15, January, 1950.

Additive color reproduction may be obtained by exposing a photosensitive silver halide emulsion through an additive color screen having filter media or screen elements each of an individual additive color such as red, or green, or blue, and by viewing the reversed or positive silver image formed by transfer to a transparent print-receiving element through the same or a similar screen which is suitably registered with the reversed positive image carried by the print-receiving layer.

As examples of suitable film structures for employment in additive color photography mention may be made of the U.S. Pat. Nos. 3,861,885, 2,726,154, 2,944,894, 3,536,488, 3,615,427, 3,615,428, 3,615,429, 3,615,426, and 3,894,871.

The utility of such film units wherein the silver halide layer remains an integral portion of the film unit subsequent to positive image formation is achieved by employing as the image-receiving element a layer which provides an unusually effective silver precipitating environment which causes the silver deposited therein to possess extraordinarily high covering power in comparison with negative silver developed in the silver halide layer.

The above-mentioned integral film unit, particularly those of the above-disclosed U.S. patents, are particularly desirable for employment as cine film for motion picture projection, for example, such as the cine film system described in U.S. Pat. No. 3,615,427 issued Oct. 26, 1971. Processing of such film units as well as the specific composition of the processing composition is detailed in the aforementioned patents.

It is known in the art that various inorganic materials may be disposed in the photosensitive silver halide emulsion layer for the purpose of providing an increase in film speed. For example, British Pat. No. 504,283 issued Apr. 21, 1939 is directed to a silver halide emulsion layer having incorporated therein pigment particles. Among the pigment materials suitable for use as a diffusing medium, mention is made of titanium dioxide, zinc oxide, magnesium oxide, zirconium oxide, silicates, and the like. It is also stated that the pigments must be substantially unaffected by the solutions normally used in processing the silver halide emulsion layers.

U.S. Pat. No. 3,462,265 issued Aug. 19, 1969 discloses and claims the utilization of particulate aluminum especially in flake form uniformly disposed in a layer of photosensitive silver halide. One advantage that accrues from the employment of said aluminum flake is an increase in the film speed as a result of the reflection of part of the incident light during the exposure by the aluminum flake thereby producing a stronger latent image.

Employment of some of the above-mentioned materials in photosensitive silver halide layers in film units of the projection type, such as the integral film units set forth in the above-indicated U.S. patents, while increasing the film speed of the emulsions, is detrimental to the finished product since some of the materials remain in the emulsion, associated with the positive image, thus blocking or diffusing some the light incident on the film unit necessary for projection of the image. In effect, therefore, many of such speed increasing materials cannot be effectively employed in transparency or other projection type film units.

The coating art has employed for a number of years microscopic air bubbles or microvoids in organic binder materials as an opacifying material to provide coatings without pigment or with a minimum of pigment. Such microvoids find employment in pressure and heat sensitive films to produce inkless printable surfaces, duplicating paper, chart recording paper, and the like. Microvoid structures have been produced in a number of ways, for example, by freeze drying, extraction, phase incompatibility, imperfect packing and the use of solvent and non-solvent combinations for a polymer in wet coating formulations. More details may be found on the preparation and use of microvoids in the *Journal of Paint Technology,* Vol. 43, No. 559, August, 1971, pages 48 to 53, and by *Md. Eng. Chem. Prod. Res. Develop,* Vol. 13, No. 1, 1974, pages 30 to 33. The latter article includes a summary of patent literature relating to microvoids.

SUMMARY OF THE INVENTION

The present invention is directed to a photographic silver halide emulsion layer having microvoids uniformly disposed therein. The employment of silver halide emulsions of the present invention in integral projection type film units, particularly in additive color film units, is particularly advantageous since the microvoids disappear upon contacting the emulsion layer with the liquid photographic processing composition, thus eliminating the possibility of the microvoids interfering with the viewing of the projected image.

BRIEF DESCRIPTION OF THE DRAWINGS

The figures illustrate characteristic curves of a control and film units of the present invention.

DETAILED DESCRIPTION OF THE INVENTION

Figure 1:
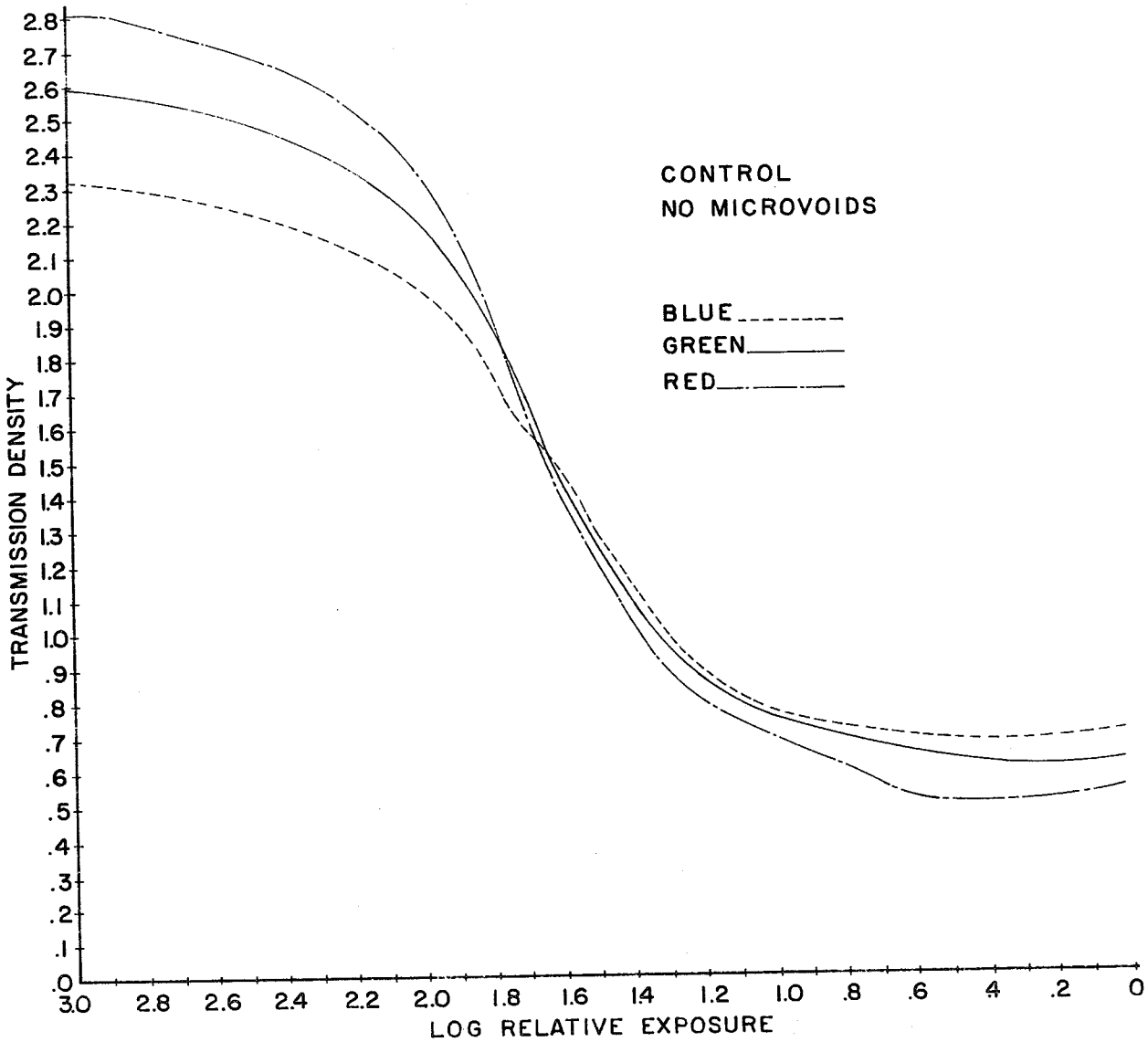

It has been found that, by employing gelatin-silver halide emulsion layers with microvoids disposed therein, an increase in the film speed, over similar emulsions which do not contain the microvoids, in excess of a stop has been achieved. The emulsion layers of the present invention generally present a hazy, white appearance as a result of the microvoids disposed therein. The microvoids tend to scatter the light incident on the emulsion layer as a result of the difference in refractive index between the microvoids and the gelatin or other binder material in which they are retained. The aforementioned scattering results in more efficient exposure of silver halide and a stronger latent image. Thus, the microvoids increase the effective speed of the emulsion as a result of the light scattering mechanism which provides more efficient utilization of the light by virtue of its longer path length.

While the exact structure of the microvoids is unknown, it is believed that the microvoids comprise discrete, essentially spherical, air-containing microcapsules with substantially continuous solid walls, generally submicron in size. The microvoids may also comprise irregularly shaped voids or channels, e.g., in a sponge-like arrangement; and, in some cases comprise open pore cells. Since the walls of the microvoid comprise the binder material that it is disposed in, a softening of the binder material will result in the collapse of the microvoids, dissipation of the air retained therein and resultant clearing of the silver halide layer. Thus, upon contact with the photographic processing composition employed to develop the latent image retained therein or by contact with other suitable softening agent for the silver halide emulsion layer, the microvoids disappear.

The microvoids preferably comprise at least about 25% by volume of the emulsion layer and, more preferably at least about 75% by volume. As stated above, the novel silver halide emulsion layers of the present invention are particularly useful in transparency or projection type films of the integral type, that is, where the silver halide emulsion layer is retained in superposition with the positive silver image. The present invention is particularly suitable for use in such integral structures employing a multicolor additive color screen. Thus, the speed enhancement of the silver halide emulsion layer is achieved and then the initial haze of the silver halide emulsion layer caused by the presence of the microvoids is discharged providing the requisite clarity for projection to the retained silver halide emulsion layer.

As stated above, a number of methods are known for preparing microvoids. One of the most suitable methods for forming the silver halide emulsion layers of the present invention comprises an in situ preparation of the microvoids which involves adding to a solution of the silver halide emulsion, an organic solvent which is miscible with the solvent for the silver halide binder material, but which is a non-solvent for the binder material; casting a layer and drying. The organic solvent is selected so that it possesses a vapor pressure less than the solvent for the binder material so that the solvent for the binder material will evaporate first leaving the organic solvent in the interstices of the binder material which hardens around the pockets of solvent. The continued drying then results in the evaporation of the organic solvent leaving air pockets or microvoids in the now-hardened binder layer.

In the case of gelatin, the most widely employed binder material for silver halide emulsion layers, an organic solvent such as ethoxy ethanol or diacetone alcohol, is added to a water solution of the gelatin-silver halide emulsion solution. A layer of the mixture is cast and dried. While drying is preferably at elevated temperatures to shorten the preparation time, room temperature may also be employed. The water will evaporate first from the mixture resulting in a hardened gelatin matrix, retaining pockets of the organic solvent which, upon continued drying, also evaporate thus forming the microvoids in the gelatin and producing the milky, hazy appearance of the gelatin-silver halide emulsion layer which evidences the presence of the microvoids uniformly disposed therein and the difference in the refractive index between the microvoids and the gelatin binder material. Other suitable organic solvents which may be employed with gelatin include butoxyethanol, methoxyethanol, 3-methoxy-1-butanol, propylene glycol monomethyl ether and dipropylene glycol monomethyl ether. Although it was stated above that the organic solvent should be miscible with the solvent for the binder material, it should be understood that the organic solvent does not have to be miscible per se but may be rendered miscible by the employing of an emulsifying agent or homogenizers. Mixtures of organic solvents may also be employed.

In an alternative embodiment, the microvoids are formed in an already cast and dried layer of silver halide emulsion. In this embodiment, a dried silver halide emulsion layer is contacted with a mixture of a solvent for the silver halide binder material and an organic solvent which is miscible with the solvent for the binder material but which is a nonsolvent for the binder material; and then redrying the silver halide emulsion layer. In a particularly preferred embodiment, a hardener for the binder material, e.g., chrome alum, in the case of gelatin is also employed. In still another embodiment, the mixture of the solvent and non-solvent includes a surfactant.

In still another embodiment a conventional blowing agent such as methylene chloride is employed. However, care should be taken to select a blowing agent which is not photographically detrimental to the film unit.

As stated above, drying conditions are not critical but are selected with regard to the particular solvent employed, the concentration and so forth. While the proportions of materials employed will depend upon the binder material and the specific solvent selected, in the case of gelatin as the binder material, it has been found that 2 to 10 cc. of organic solvent per 10 cc. of a 10% gelatin solution may be employed. A preferred level of solvent is 5 to 7 cc. per 10 cc of 10 % gelatin solution. The particular solvents and solvent concentrations are selected to provide a homogeneous dispersion within the gelatin solution.

The following non-limiting example illustrates the novel product of the present invention.

EXAMPLE

A master batch was prepared as follows:
Gelatin (10% solution; 120 g.
Algin (2.5% solution); 80 g.
Igepal CO-630 (non-ionic surfactant, nonyl phenoxy polyoxyethylene ethanol, 2% solution); 30 g.
A coating mixtuure was then prepared as follows:
Above master batch; 86.7 g.
Diacetone alcohol; 75.9 g.
Water; 10 cc.

A panchromatically sensitized gelatino silver iodobromide emulsion (3/1 gelatin/silver ratio); 62.3 g. The emulsion coating was then dried at 140° F. for about ½ hour. The resulting emulsion layer had a hazy, whitish appearance indicating the presence of microvoids.

Film units were then prepared comprising a transparent polyester film base carrying on one surface an additive color screen of approximately 1000 lines each per inch of red, blue, and green filter screen elements in repetitive side-by-side relationship; a 4 micron thick protective overcoat layer comprising a layer of vinylidine chloride/acrylonitrile copolymer; a nucleating layer comprising palladium nuclei prepared according to the procedure in Example 8 of application Ser. No. 649,201, filed Jan. 14, 1976, at a coverage of 0.2 mgs/ft$^2$ Pd and 0.3 mgs/ft$^2$ gelatin; a copper/deacetylated chitin layer, comprising 7.4 mgs/ft$^2$ of chitin and 0.68 mgs/ft$^2$ $Cu^{+2}$ as cupric acetate; a panchromatically sensitized, silver iodo-bromide emulsion, as described above, coated at a coverage of about 100 mgs/ft$^2$ of silver.

To provide a control, one film unit was washed with water to collapse the microvoids and then again dried.

A second film was not treated prior to exposure.

A third film unit was prepared as above except that the emulsion contained no microvoids.

The above-described film units were exposed in the same manner to a conventional step wedge and were developed by contacting the film units for about 60 seconds with a processing composition comprising about 71% water, 0.2% triaminophenol 1.0% hydroxyethyl cellulose, 5% sodium hydroxide, 3.6% sodium thiosulfate, 8% sodium sulfite, 0.26% 6-nitrobenzimidazole, 8% tetramethyl reductic acid, 0.2% 2, 6-dimethylaminophenol, and 0.2% 2-mercapto-benzothiazole.

Figure 2:
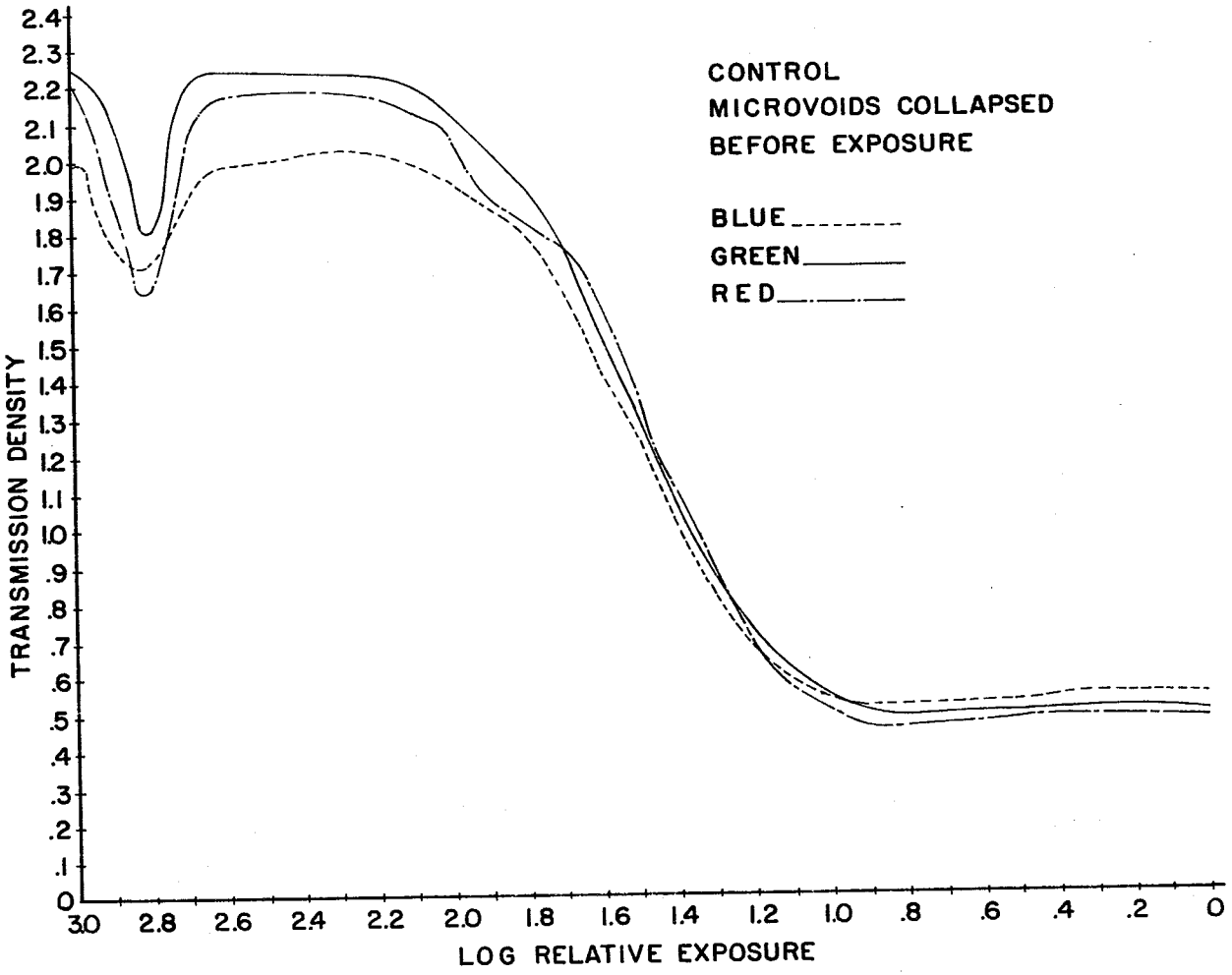
Figure 3:
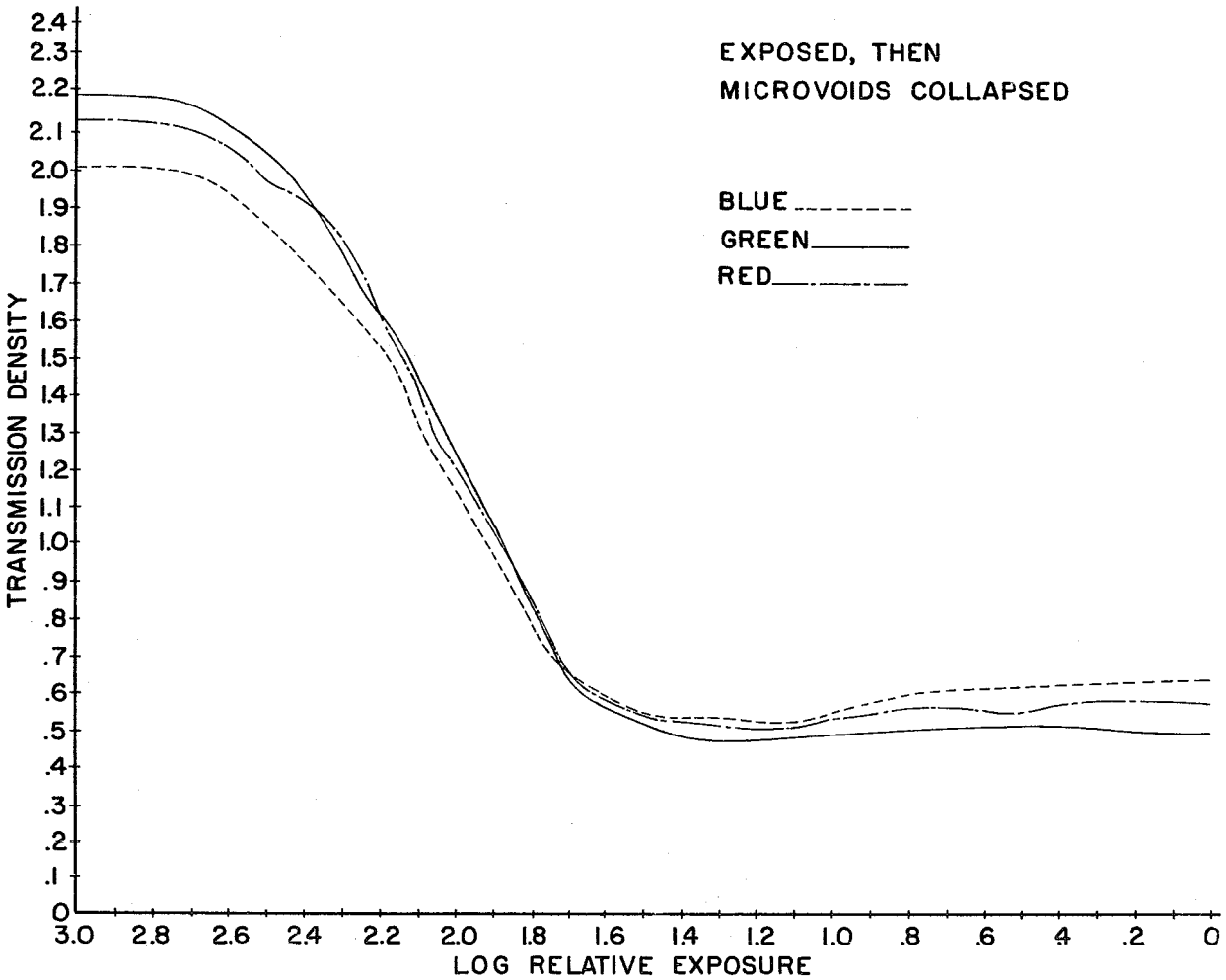

FIGS. 1, 2 and 3 illustrate an analysis of the film units with an analytical densitometer. From a comparison of the characteristic curves, (in terms of transmission density) it will be noted that greater speed (about 1¾ stops) is found in the film unit which contains micro voids during exposure which can be attributed to the microvoids. It should also be noted that the speed of the two central film units is substantially the same.

In an alternative embodiment, a relatively small amount of a light-reflecting inorganic pigment may be employed in the emulsions of the present invention. Such pigments are those conventionally employed in light-scattering systems; however, in the present invention are employed at level sufficiently low to substantially obviate any contribution to optical density. Thus, a second light-scatterer can be employed to further enhance the light scattering effect of the microvoids. In a particularly preferred embodiment, titanium dioxide at a level of 1 to 15 mgs/ft$^2$ is employed.

It has also been found, surprisingly, that a relatively low level of carbon black employed in the emulsion with the microvoids enhance resolution. The carbon black is employed at a sufficiently low level to minimize any contribution to transmission density. In a particularly preferred embodiment 0.5 to 8 mgs/ft$^2$ is employed.

Although the binder material employed in the present invention is preferably gelatin since that is the most widely used binder material for photographic silver halide emulsions, it should be understood that any binder material, natural or synthetic, employed in the art for photographic silver halide emulsions may be employed in the present invention. In a preferred method for forming the microvoids is only necessary that a material which is a nonsolvent for the binder material and which is miscible with the solvent for the binder material be homogeneously dispersed in the binder solution and then removed by drying to provide the layer containing the microvoids.

It should be understood that additional layers may optionally be employed with the photosensitive element of the present invention such as, for example, separate layers retaining processing reagents, barrier layers, protective layers, and the like. If desired, an antihalation layer may be employed with the novel photosensitive element of the present invention.

Although described primarily in terms of additive color film units, it should be understood that the novel silver halide emulsion layer of the present invention may be employed in black and white and subtractive multicolor film units as well.

In the practice of the present invention in diffusion transfer processing, the silver precipitating nuclei may be disposed within the photosensitive silver halide stratum of the film unit assemblages in a separate layer or in layers contiguous to one or both surfaces of the silver halide stratum and the silver halide stratum may comprise two or more silver halide strata, each optionally containing silver precipitating nuclei and may include separate silver precipitating nuclei positioned intermediate separate silver halide strata.

The types and quantities of silver precipitating nuclei suitable for use in the present invention are set forth in the above-mentioned patents and particularly in the aforementioned U.S. Pat. Nos. 3,615,426; 3,615,427; 3,615,428; and 3,615,429 and copending application Ser. No. 649,201, filed Jan. 14, 1976. The above-described copper/chitin layers are disclosed and claimed in copending application Ser. No. 697,106, filed June 17, 1976.

Silver halide emulsions suitable for use in the present invention are detailed in the above-mentioned patents. Particularly useful silver halide emulsions are the substituted halide silver halide emulsions described in copending application of Vivian K. Walworth, Ser. No. 383,176 filed July 27, 1973. Production of the color screen employed in additive color film units of the present invention may be achieved by any of the conventional methods known to the art. Preferred methods of screen manufacture may be found in U.S. Pat. Nos. 3,032,008; 3,229,607; and 3,318,220.

The support or film base may comprise any of the various types of transparent, rigid, flexible supports, for example, glass, polymeric films of both the synthetic type and those derived from naturally occuring products. Especially suitable materials comprise flexible transparent synthetic polymers such as polymethacrylic acid, methyl and ethyl esters thereof, vinyl chloride polymers, polyvinyl acetals, nylon, polyesters such as the polymeric films derived from ethylene glycol, terephthalic acid, polymeric cellulose derivatives such as cellulose acetate nitrate, triacetate, propionate, butyrate, or acetate propionate, polycarbonates, polystyrenes, and the like.

In addition to the aforementioned advantages of employing the microvoids of the present invention over the inorganic scattering materials such as titanium dioxide or zinc dioxide, it has been found that photographic activity due to the introduction of the inorganic materials at levels conventionally employed is obviated by the employment of the totally inert microvoids or the employment of microvoids and reduced levels of inorganic scattering materials.

What is claimed is:

1. A photosensitive element comprising a support carrying a silver halide emulsion layer containing microvoids less than 1 micron average diameter and adapted to scatter light incident on said layer and said microvoids further adapted to collapse upon contact with aqueous alkaline photographic processing composition wherein said microvoids comprise at least about 25% by volume of said emulsion layer.

2. The element as defined in claim 1 wherein the binder of said silver halide emulsion layer comprises gelatin.

3. The element as defined in claim 1 wherein said microvoids comprise at least about 75% by volume of said emulsion layer.

4. The element as defined in claim 1 wherein said silver halide emulsion layer contains titanium dioxide.

5. The element as defined in claim 1 wherein said silver halide emulsion layer contains carbon black.

6. The element as defined in claim 5 wherein said carbon black is present at a level of about 0.5 to 8 mgs/ft$^2$.

7. An additive color diffusion transfer film unit which comprises a transparent support carrying, in order, an additive color screen, a layer comprising silver precipitating nuclei, and a photosensitive silver halide emulsion layer containing microvoids less than 1 micron average diameter and adapted to scatter light incident on said silver halide emulsion layer, and said microvoids further adapted to collapse upon contact with aqueous alkaline photographic processing composition wherein said microvoids comprise at least about 25% by volume of said emulsion layer.

8. A film unit as defined in claim 7 wherein said silver halide emulsion layer comprises a gelatin binder.

9. A film unit as defined in claim 7 wherein said silver halide layer has a silver coverage of less than about 200 mgs/ft$^2$ of silver.

10. A film unit as defined in claim 7 wherein said microvoids comprise at least about 75% of said emulsion layer.

11. A film unit as defined in claim 7 wherein said silver halide emulsion layer contains carbon black.

12. A film unit as defined in claim 11 wherein said carbon black is present at a level of about 0.5 to 8 mgs/ft$^2$.

13. A film unit as defined in claim 7 wherein said screen comprises a trichromatic screen possessing red, green and blue optical filter elements.

14. A photographic process which comprises the steps of:

(a) Exposing a film unit which comprises, in order, a support carrying an additive multi-color screen, a silver precipitating layer, a layer comprising photosensitive silver halide crystals and microvoids less than one micron average diameter and adapted to scatter light incident on said layer comprising silver halide crystals, said microvoids comprising at least about 25% by volume of said layer comprising silver halide crystals; and (b) contacting exposed film unit with an aqueous alkaline photographic processing composition to develop said exposed silver halide emulsion and to form a silver transfer image in said silver precipitating layer and to collapse said microvoids.

* * * * *